US009957020B2

(12) United States Patent
Mead

(10) Patent No.: US 9,957,020 B2
(45) **Date of Patent: *May 1, 2018**

(54) LOW-DRAG FIN AND FOIL SYSTEM FOR SURFBOARDS

(71) Applicant: Kirby J. Mead, Whittier, CA (US)

(72) Inventor: Kirby J. Mead, Whittier, CA (US)

( * ) Notice: Subject to any disclaimer, the term of this patent is extended or adjusted under 35 U.S.C. 154(b) by 113 days.

This patent is subject to a terminal disclaimer.

(21) Appl. No.: 15/215,872

(22) Filed: Jul. 21, 2016

(65) Prior Publication Data

US 2016/0347427 A1 Dec. 1, 2016

Related U.S. Application Data

(63) Continuation of application No. 14/336,677, filed on Jul. 21, 2014, now abandoned, which is a continuation of application No. 14/095,643, filed on Dec. 3, 2013, now Pat. No. 88,215,205, which is a continuation of application No. 13/616,025, filed on Sep. 14, 2012, now Pat. No. 8,613,636, which is a continuation of application No. 11/764,027, filed as application No. PCT/US2005/045791 on Dec. 16, 2005, now Pat. No. 8,328,593.

(60) Provisional application No. 60/637,299, filed on Dec. 17, 2004.

(51) Int. Cl.
*B63B 35/79* (2006.01)
*B63B 39/06* (2006.01)

(52) U.S. Cl.
CPC ..... *B63B 35/7926* (2013.01); *B63B 35/79* (2013.01); *B63B 35/7906* (2013.01); *B63B 39/06* (2013.01)

(58) Field of Classification Search
CPC ..... B63B 35/79; B63B 2035/7905; B63B 35/7906; B63B 35/7923; B63B 35/7926; B63B 35/793; B63B 39/06
USPC ..... D21/769
See application file for complete search history.

(56) References Cited

U.S. PATENT DOCUMENTS

| | | | |
|---|---|---|---|
| 934,771 | A | 9/1909 | Turnbull |
| 1,571,989 | A | 2/1926 | Zimmermann |
| 3,261,297 | A | 7/1966 | Daniel |
| 3,952,971 | A | 4/1976 | Whitcomb |

(Continued)

FOREIGN PATENT DOCUMENTS

| | | | |
|---|---|---|---|
| AU | 2005316366 | B2 | 6/2012 |
| AU | 2012219417 | A1 | 10/2012 |

(Continued)

*Primary Examiner* — Ajay Vasudeva
(74) *Attorney, Agent, or Firm* — Shartsis Friese LLP; Cecily Anne O'Regan

(57) ABSTRACT

The present invention is a Low-Drag Fin and Foil System for Surfboards (10), particularly including cambered fin foils (40; 42). The invention (10) also discloses low-drag, directionally unstable fin positions wherein the lesser of negative angle of attack of a trailing fin (50), versus the higher or positive angle of attack of a forward fin (48), makes the board (12) highly maneuverable by creating a yawing moment that aids the rotation of the board (12) as it is turned. The system particularly utilizes fins (40) having foil (42) shapes in which either the cambered side (74) or the non-cambered side (76) is provided with a combination of a convex curvature (68) and a concave curvature (70) to result in an oscillating curvature (72) which has a positive effect on control and acceleration.

8 Claims, 8 Drawing Sheets

(56) References Cited

U.S. PATENT DOCUMENTS

| | | | | |
|---|---|---|---|---|
| 4,455,003 | A | 6/1984 | Hilbig | |
| 4,773,825 | A | 9/1988 | Rodde et al. | |
| 4,780,058 | A | 10/1988 | Phillips | |
| 5,152,705 | A | 10/1992 | Rock | |
| D428,459 | S | 7/2000 | Broz et al. | |
| 6,439,940 | B1 | 8/2002 | Pouchkarev | |
| 6,585,549 | B1 | 7/2003 | Fryar | |
| 6,718,897 | B1 * | 4/2004 | De Bello | B63B 1/36 441/74 |
| D515,684 | S | 2/2006 | Latone | |
| 7,192,323 | B2 | 3/2007 | Smith | |
| 7,524,225 | B1 * | 4/2009 | Richenberg | B63B 35/7926 441/74 |
| 8,328,593 | B2 | 12/2012 | Mead | |
| 8,613,636 | B2 | 12/2013 | Mead | |
| 8,821,205 | B2 | 9/2014 | Mead | |
| 2004/0092180 | A1 | 5/2004 | Turkington | |
| 2008/0287018 | A1 * | 11/2008 | Johnson | B63B 35/7926 441/74 |
| 2008/0311806 | A1 | 12/2008 | Mead | |
| 2013/0012083 | A1 | 1/2013 | Mead | |
| 2015/0044921 | A1 | 2/2015 | Mead | |

FOREIGN PATENT DOCUMENTS

| | | | |
|---|---|---|---|
| DE | 9307054 | | 7/1993 |
| DE | 29700532 | U1 | 4/1997 |
| FR | 2878502 | A1 | 6/2006 |
| WO | 0107315 | A1 | 2/2001 |
| WO | 2005066018 | A1 | 7/2005 |
| WO | 2006066140 | A2 | 6/2006 |

* cited by examiner

LOW-DRAG FIN AND FOIL SYSTEM FOR SURFBOARDS

CROSS-REFERENCE

This application is a continuation of application Ser. No. 14/336,677 filed Jul. 21, 2014, which is a continuation of application Ser. No. 14/095,643 filed Dec. 3, 2013, which is a continuation of application Ser. No. 13/616,025 filed Sep. 14, 2012, now U.S. Pat. No. 8,613,636, which is a continuation of application Ser. No. 11/764,027 filed Jun. 15, 2007, now U.S. Pat. No. 8,328,593, which is a continuation of International Application Number PCT/US2005/045791 filed Dec. 16, 2005, which claims priority from U.S. Provisional Application No. 60/637,299 filed Dec. 17, 2004, by the same inventor, the contents of which are incorporated herein.

TECHNICAL FIELD

This invention relates to surfboards, and more particularly to the foil of the fin on multi-fin type boards, and to the positioning of the fins on the bottom of the board.

BACKGROUND ART

Prior to the initial experimentation with double-finned surfboards in the early 1970's, a single center fin, located at the very tail of the board, provided the directional stability essential to the basic performance of the board. Since the advent of tri-fin or "thruster" type surfboards in the early 1980's, high-performance surfboards have also incorporated two side-fins to dramatically increase the board's speed and maneuverability. The side-fins are located on opposite sides of the board near the perimeter edge or "rail," and well forward of the single, central trailing fin at the tail.

In the tri-fin configuration, it is well established that the center fin is primarily a stabilizing fin and functions in a manner very similar to the fixed keel on a sailboat or the vertical stabilizer on an aircraft—i.e. if the board yaws or departs from its original heading, the rotation of the board causes the water-flow to strike the fin at an angle; this creates a low-pressure area on the opposite or lee side of the fin that resists the yaw, and allows directional stability to be maintained.

Knowledge is still very limited, however, as to how the side-fins enhance the speed and maneuverability of modern multi-finned type boards. This has long been a major problem in surfboard design. As a result, the first, largely experimental "twin-fin" and "fish" style surfboards, the double-finned predecessors of the modern tri-fin, suffered for many years from a variety of poorly understood control problems. The early control problems—which were collectively referred to as "tracking"—were found to be greatly reduced by using a negatively angled side-fin setting. Although this eliminated the original tracking problem, it also caused an overly loose, drifting type of turn that many riders, even at the expert level, found very difficult to control. Eventually, the problem was remedied by adding a third stabilizing fin at the very tail of the board, the configuration in current use today. Though much faster and more maneuverable than the single-finned board types that preceded it, the current tri-fin setting was arrived at almost entirely through trial and error; as a consequence, it retains features that actually contribute to a marked increase in drag. The main drawbacks of prior art tri-fins may be summarized briefly as follows:

Each side-fin is set at a negative angle of attack or "toe-in" angle of between three and five degrees, so that the leading edge points in the approximate direction of the longitudinal centerline at the nose. The angle is measured using the chord line (a straight line drawn through the leading and trailing edges of the fin at the fin base), which is referenced to the longitudinal centerline provided by the wooden center spar or "stringer" that runs the length of the board. The negative angle of attack or toe-in causes the water-flow to strike the side-fins at an angle, and creates high drag from the "snow-plow" effect when the rider's weight is neutrally centered on the board.

The cambered foil of the side-fin adds to this drag: in the longitudinal cross-section view commonly used to depict the airfoil section of a wing, the foil of the side-fin is asymmetrical, and has an average curvature greater on one side than the other. The foil of the conventional prior art side-fin is flat to slightly concave on the inside surface (the side facing the longitudinal centerline or stringer), and curved on the outside (the side facing the perimeter edge or "rail"). Although the cambered side-fin foil appears to give better performance and greater average speed, knowledge is currently very limited as to the reasons why, since both the flat-sided, and particularly the slightly concave side-fin foil, would appear to greatly increase the drag from the negative toe-in angle. It is well known that separation of the boundary layer and turbulence occurs more readily when a flat or concave surface is set at an angle to a fluid flow, versus a symmetrical foil, for example, where both sides are convex and curve equally in opposite directions in a low-drag, streamlined shape.

Currently, the rider can overcome the high drag of the side-fin setting by constantly turning the board. As noted above, the high drag condition occurs primarily when the rider's weight is neutrally centered on the board—the drag is reduced, however, when the rider leans to initiate a turn and lifts the opposing side-fin free; the angle of the side-fin remaining in the water then acts like a deflected rudder and aids the board's rotation in the turn; on a tri-fin board, the rider's normal weight shift further in the turn will then set the center stabilizing fin, and prevent the overly loose, difficult to control, drifting type of turn that, subsequent to the "tracking" problem, was the major drawback that greatly limited the acceptance of the early double-finned style boards. Surfboard designers have long noted that adding a third stabilizing fin does little to diminish the maneuverability of the board—it instead produces such a noticeable burst of speed and acceleration in a turn that, in the early development of the tri-fin, the center stabilizing fin almost immediately came to be referred to as "thruster" fin, and the tri-fin set-up as a "thruster" type board. In the tri-fin or thruster configuration, however, the addition of the center stabilizing fin causes a third and final drawback:

The location of the center stabilizing fin is precisely the opposite of the optimum theoretical configuration: i.e., if the negatively angled side-fin functions as a deflected rudder, it should be placed as far behind the board's axis of rotation as possible so as to increase its moment arm; the added leverage would lessen the surface area of the side-fin and the amount of negative toe-in angle required for a given turning moment, and thereby reduce drag. Locating the fin or fins required for directional stability forward of a negatively angled trailing fin, closer to the axis of rotation, would increase the directional instability of the fin-setting by allowing the negatively angled rearward fin to truly function as a permanently deflected rudder. Failure to correct the drawbacks outlined above, and the absence of innovation regarding fin placement on multi-fin type boards (the group includes other multi-finned variants, e.g., "twinzers," "quads," "fishes," etc. all of which use the negatively angled side-fin setting), is largely due to the poor understanding of the role the fins play in enhancing the performance of the board. Despite the high speed and exceptional maneuverability of modern multi-finned boards vs. the early single-finned board types, at present, their higher performance actually comes at a cost of considerable drag. From a hydrodynamic standpoint, it can be seen that the board-making arts currently have need of a cambered side-fin foil that exhibits reduced drag at the conventional negatively angled side-fin setting, as well as multi-fin arrangements that will introduce directional instability, but at a reduction in drag over the multi-fin configurations of the prior art.

The following description is intended to impart an understanding of the present invention to a person skilled in the art of surfboard design. Those skilled in the art, however, will be aware of the current lack of tank-testing facilities, and the absence of any method that can accurately duplicate a breaking wave, the movement of the board on a wave, or the effects of the rider maneuvering the board in a controlled setting. Therefore, at least some of the material disclosed herein is a subjective interpretation of observed phenomena, and the descriptions provided below should not be interpreted in a way that will limit the invention, which is defined more fully and accurately in the appended claims.

At the time the present invention was made, the board-making arts lacked an explanation for the clearly superior performance of multi-finned type boards. As will be appreciated by those skilled in the art upon reviewing the disclosure below, the much higher speed of currently available multi-finned boards can be largely attributed to the higher lift coefficient of the cambered side-fin foil. The following detailed description of the invention therefore begins with a discussion of the relationship between the (hydro-) foil of the fin, and the airfoils of a wing and a sail, which respond in similar ways to a fluid flow despite the differing densities between air and water.

Sailboats and aircraft are able to maneuver because of the differential "lift" of a plurality of separate air- and hydrofoils at differing angles of attack: on a sailboat, for example, the "lift" of the deflected rudder creates a yawing moment behind the fixed keel that causes the sailboat to rotate in a turn; on an airplane, the differential lift between the wing and the horizontal tail (as altered by deflected control surfaces such as ailerons, elevons, the elevator, etc.) makes it possible for the aircraft to execute banked turns and fly in a loop. The board-designer, therefore, may use the same principles and analyze the angle of attack of the fin(s) relative to the direction of the water-flow through a turn, and arrange the fins, and the foil of the fins, to optimize the speed and performance of the multi-finned board as it is maneuvered on a wave.

Board designers may therefore benefit from a fuller knowledge of the similarities between the hydrofoil of the fin and the airfoil of the wing and sail, and make use of the extensive aeronautical research that has been compiled comparing the performance of various airfoil sections at different wind speeds and angles of attack. As shown in greater detail below, aeronautical engineers have developed sophisticated means of accurately measuring the performance of a wing; typically, the relevant wind tunnel data are plotted in graph form or, as shown in FIG. 1A and FIG. 1B, by using vectors, in which the length and direction of an arrow indicates the magnitude and direction of the force of the air pressure, or pressure field, that develops around the airfoil of a wing in response to its incidence, or angle of attack, relative to the airstream. For illustration purposes, the vectors shown in FIG. 1A and FIG. 1B, which actually represent the pressure differential around the airfoil of a wing, will be assumed to be completely interchangeable with the flat-sided cambered side-fin foil of the prior art. In addition, although the foils in FIG. 1A and FIG. 1B are depicted in a vertical orientation, in the following discussion they will be referred to as being in a horizontal position when the description is of an airfoil in flight, while the fluid flow F will be understood to represent both air- and water-flow.

In FIG. 1A, the vectors shown represent the pressure differential typically seen around the airfoil of a wing at cruise, when the airstream or airflow F is almost parallel to the airfoil of the wing. Ordinarily, the aircraft is designed so that the airplane's fuselage is completely level under normal flight conditions for minimum drag, while the wing is positioned at a very low but slightly positive angle of attack (e.g., typically about two degrees), so that the highest pressure will be at the leading edge of the wing, as shown, while the much lower pressure on the upper surface of the airfoil holds the aircraft aloft.

In aircraft design, a basic problem is that the pressure field depicted in FIG. 1A is unequal; as a result, the wing has a "pitching moment" and the aircraft tends to nose downward until the pressure around the wing is equalized. To prevent this, a horizontal stabilizer is provided at the tail, the airfoil of which is set at a slightly negative incidence or angle of attack so as to provide steady downward pressure, which counters the pitching moment of the wing and allows the aircraft to remain in steady, level flight.

Comparing the foil of a board fin to the airfoil of the wing, it can be assumed that a parallel side-fin setting will create a "yawing moment" similar to the pitching moment of the wing, and create control problems that would require a negatively angled trailing fin to counter, assuming the example set in aircraft design is followed. In surfboard design, however, the "tracking" problems exhibited by the very early fish style boards, which originally used a parallel side-fin setting, were eliminated by changing the fin position so the side-fin was fixed at a negative angle of attack. Despite the high drag and snowplow effect of the now standard, negatively angled side-fin setting, the modern multi-finned board type is much faster than the single-finned board types that preceded it. As will be appreciated by those of skill in the art after reading the disclosure below, this is because the rotation of the board in a turn places the side-fin foil at a high angle of attack, and a pressure differential forms around the fin that is much like the airfoil of a wing or sail at a similar angle of attack, as described in greater detail below.

In FIG. 1B, the pressure differential shown is typical of an airfoil at a very high angle of attack, when the airflow F is striking the underside of the wing, as is the case when the aircraft is flying in a loop or pulling out of a dive. Note that in either case the motion of the aircraft describes an arc, and that the direction of the airflow F is almost entirely due to the motion of the aircraft itself (assuming a still day with little breeze). When the airfoil is at a high angle of attack as shown, a very large area of negative pressure develops around the leading edge of the airfoil and pulls the wing forward. It is known that a similar area of low-pressure around the forward portion of a sail drives a sailboat forward and enables it to sail into the wind. From FIG. 1B, it can be assumed that if the rotation of the board through a turn places the fin at a correspondingly high angle of attack, an area of very low pressure will develop around the leading edge of the fin and accelerate the board forward; the aforementioned effect provides an explanation for the greater speed of multi-finned type boards.

In terms of board design, however, it is equally important to note that the pressure differential between the leading and trailing sections of the airfoil in FIG. 1B is very large; hence, an airfoil at a high angle of attack tends to have a very large pitching moment (in the case of a wing) or yawing moment (in the case of a sail), the effects of which must be countered with considerable deflection of the elevator or rudder to maintain directional control. It can be assumed that the cambered side-fin foil at a similarly high angle of attack will also have a very large yawing moment, and that the yawing moment will be opposite the rotation of the turn. The reverse yawing moment of the side-fin in a turn provides an effective explanation for the poorly understood control problems exhibited by the original wide-tailed twin-fins and the very early double-finned fish style boards of the prior art.

As previously discussed, the "tracking" problems of the original double-finned boards were eliminated through trial and error, without benefit of the information provided in the discussion above. As a consequence, current multi-fin configurations retain a number of features that actually contribute to a marked increase in drag. The source of the drag is illustrated in more detail in FIG. 2, which depicts the bottom of a conventional tri-fin surfboard according to the prior art. As shown, the two side-fins are located on opposite sides of the board near the perimeter edge or "rail," and well forward the center stabilizing fin at the tail. When the board is at speed on the wave and the rider's weight is neutrally centered on the board, the heading H of the board will cause a water-flow F that is substantially opposite the heading; when the water-flow F parallels the longitudinal centerline or stringer as shown, the negatively angled side-fin setting, which has a standard toe-in angle of approximately four degrees, causes the water-flow F to strike the outside, cambered surface of the side-fins (the side facing the perimeter edge or rail), and creates high drag due to the low-pressure area (depicted here as turbulence) that develops on the lee or inside surface of the side-fins (the side facing the longitudinal centerline or stringer).

FIG. 2A and FIG. 2B are closer, cross-section views depicting the cambered foil of prior art side-fins. The conventional flat-sided cambered foil of the prior art is shown in FIG. 2A; for a given thickness, the prior art foil shown in FIG. 2B has slightly increased camber due to the shallow concave of the inside surface. The views depict how the negative toe-in of the side-fin causes the water-flow F to strike the side-fins at an angle, which causes the water-flow on the lee or inside surface of the side-fins to tend to separate or become turbulent, and increases drag.

Note that the actual angle of the side-fin foil in FIG. 2A and FIG. 2B is equivalent to an aircraft flying upside down; since this is known to be an inefficient way to generate lift, it follows that the negatively angled side-fin setting will compromise the basic functions of the side-fin(s), which, as will be appreciated by persons skilled in the art after reading the disclosure which follows below, are as follows: the negative toe-in angle of the side-fins improves directional stability when the rider's weight is evenly balanced on the board; when the rider leans to turn the side-fin functions as a deflected rudder and aids the board's initial rotation and, as the prior art tri-fin (shown in FIG. 2) rotates further in the turn, the angle of the water flow changes so that it is striking the "underside" of the fin(s), which places the fins of the board at a high, "flying" angle of attack and, much like a sail, accelerates the board forward.

FIG. 3A shows the rotation of the board in more detail: in the diagram depicted, the rider's weight shift when leaning in a turn creates a yawing moment YM that, in relation to the board's original heading H, changes the angle of the "apparent" water-flow F striking the fins, and places the fins at a higher angle of attack. (Note: the term "apparent" water-flow is used in the same manner as the term "apparent wind" is used in sailing-from the board's perspective, the water is "apparently" moving, although the actual angle of the water-flow striking the fins is caused almost entirely by the motion of the board itself.) In the turn shown, an arrow H represents the board's original heading (shown in FIG. 2), while the three arrows running parallel to and in an opposite direction to the first arrow are used to represent the apparent water-flow F resulting from that heading. The board's rotation in the turn is referenced by an imaginary axis of rotation AR, and the arrows at either end of the board depict the direction and rotation R of the nose and tail of the board as the rider, leaning in the turn, shoves the tail in one direction, and causes the nose to move in the opposite direction. The view shows that the movement of the tail as the board rotates causes the fins at the rear of the board to be placed at a higher angle of attack relative to the water-flow F, and increases their potential "lift." (The "lift" is depicted here as the pressure field described above. In addition, the rotation of the board and angle of attack of the fins may be better visualized if the view is assumed to be from the rider's perspective with the deck or top surface of the board transparent.)

FIG. 3B depicts a very early, and largely unsuccessful, split-tailed fish style board of the prior art, and shows that the same rotation on a board with a wide tail and correspondingly wide fin-spacing will place the side-fins at a higher angle of attack. The added problem is that on a wide-tailed board the side-fins are further away from the rider's feet—because the rider controls the board through weight shifts that are transmitted through the feet, it follows that a wide side-fin spacing will increase the moment arm of the side-fin, and that the added leverage will lead to control problems since the rider will be less able to counter the reverse yaw of the side-fins and maintain control of the board through a turn.

From the preceding discussion, it will also be apparent that increasing the length of the board or the speed at which it is ridden will exacerbate the problems outlined above. Persons knowledgeable in board design will note that the early double-finned fish style boards, which originally used the parallel side-fin setting shown in FIG. 3B and had large, low aspect ratio keel type fins, were limited to roughly five and a half feet in length. Although these boards at times exhibited exceptional speed in smaller surf, they became difficult or impossible to control at higher speeds in larger, faster waves, where the size of the board was typically increased. As a result, the parallel side-fin setting shown in FIG. 3B was quickly abandoned in favor of the negatively angled side-fin setting of the prior art. The early twin-fin style boards of the same era (not depicted) were also notoriously prone to tracking problems, particularly in larger surf. As will be appreciated by those of skill in the art after reading the disclosure below, this was due to the wide spacing of the side-fins, which were placed near the extreme edge of the very wide square tail and far from the rider's feet.

Therefore, when comparing the modern prior art tri-fin depicted in FIG. 2 and FIG. 3A to the early, wide-tailed fish of FIG. 3B, it can be seen that the design modifications have comprised a considerable narrowing of the tail; the side-fin placement has moved further forward on the board; and the side-fins are now universally set at a negative angle of attack. These design changes have had the effect of eliminating prior art control problems, but without first identifying their cause—the prior art tri-fin, which is considered to be a fast, exceptionally maneuverable board, retains the inherent drawbacks of the negatively angled side-fin setting, and suffers from seriously compromised performance and considerable unnecessary drag as a result.

Accordingly, much room remains for improvement in the structure and placement of fins and foils on surfboards.

DISCLOSURE OF THE INVENTION

An object of the present invention is to minimize drawbacks of prior art multi-finned boards caused by the negative toe-in angle and cambered foil of the side fins.

Another object of the invention is to provide a faster and more stable surfboard by providing better formed and better located fins.

Yet another object of the present invention is to significantly reduce the drag caused by the negative angle of the side-fin setting.

An additional object of the present invention is to eliminate drawbacks associated with multi-fin configurations of the prior art.

A preferred embodiment of the present invention is a system for providing a surfboard with improved fins, arranged in an improved pattern, with said pattern being customizable to the specific characteristics of the user. The fins act as foils and are improved over prior designs by changing the curvature of the side-fin foil so that one side of the fin has a first convex curvature in one direction, and a second concave curvature in the opposite direction adjacent thereto, such that that side of the fin has an oscillation similar in shape to a shallow sine wave. This oscillating curvature allows the forward portion of the fin foil, to better approach a low-drag, perfectly symmetrical shape. The trailing portion, in turn, may be curved in the same direction as the opposite side so that the overall foil section is cambered. The streamlined shape of the forward portion, combined with the curvature of the rear portion, may be used to create a "sidewash," similar to the "downwash" known to exist behind an airplane wing, that alters the angle of the water-flow striking a trailing fin, thereby changing the effective incidence or angle of attack of the trailing fin, in order to reduce drag or to induce a yawing moment that makes the fin-setting directionally unstable.

Improved fin foils and multi-fin configurations of the present invention are based on an analysis of how the angle of attack an individual fin can be combined with a secondary fin at a different angle to dramatically improve the speed and performance of multi-finned boards. This involves two closely related premises, which are summarized briefly as follows: The rotation of the board as it is turned places the fin(s) at a high angle of attack relative to the water flow resulting from the board's original heading; when a fin foil having a high lift coefficient is placed at a high angle of attack to a water flow, it develops an area of very low pressure around its leading edge similar to the low-pressure area known to develop around the forward portion of a sail. Like a sail, the fin will accelerate the board forward before the exaggerated yawing motion of the turn, and the pressure differential around the fin, is stabilized. The addition of the trailing "thruster" fin has the same effect, although the potential thrust or acceleration it can deliver is currently greatly diminished by the lower lift coefficient of its symmetrical foil. Because the performance of the sail is known to dramatically improve using features that enhance the lift and aerodynamic performance of a wing, the performance of the fin can be enhanced using the same measures.

According to the present invention, the rotation of the board in a turn places the side-fin foil at a high angle of attack, and a pressure differential forms around the fin that is much like the airfoil of a wing or sail at a similar angle of attack, as described in greater detail below.

The oscillating curvature occupies one entire side of the fin in a preferred embodiment, only a portion of one side (e.g., from approximately mid-chord to the trailing edge) in another embodiment, while the curvature may be placed on the cambered side (i.e., the side having the greater average curvature), or the side opposite the cambered side; the curvature may occupy the inside surface of the fin (i.e., the side facing the longitudinal centerline or stringer) or the outside surface (i.e., the side facing the perimeter edge or "rail") in other embodiments, depending on the specific performance characteristics sought.

A preferred embodiment of the arrangement of fins in the present invention provides a side-fin setting wherein the chord line of a rearward side-fin is set at a negative angle to the chord line of at least one forward fin, such that the rearward fin creates a yawing moment or force aiding the rotation of the board through a turn; in an added embodiment, the chord line of a forward fin is set at a positive angle as measured against the longitudinal centerline or stringer and the chord line of at least one rearward side-fin, so that the forward fin will lead the rotation of the board through a turn. In either case, the juxtaposition of fins is such that the lesser angle of attack of the rearward fin, versus the higher angle of attack of at least one forward fin, will create a yawing moment that causes the direction of the water-flow striking the forward fin to come at a progressively higher angle of attack, thereby enhancing both the rotation and the acceleration of the board through the arc of the turn.

In an additional embodiment, the present invention provides a side-fin setting that is substantially parallel to the longitudinal centerline. The poorly understood control problems associated with the parallel side-fin setting originally used on the very early double-finned fish style surfboards of the prior art, were caused by a fin-setting that placed the side-fins too close to the tail and to the board's perimeter edge or "rail." The present invention provides a method by which parallel side fins may be successfully used if the side-fins are set closer to the axis of rotation and further away from the perimeter rail. Specifically, if the side-fins are set so the mid-chord of the side-fin (as measured at its base) is at least fifteen percent of the total length of the board forward from the tail, and if the distance between the longitudinal centerline of the board and the mid-chord of the side fin (as measured at its base) is no greater than one-third the total width of the board at that point, the control problems resulting from the parallel side-fin setting largely disappear. Additional fins, which function to dampen or counteract the reverse yaw of the side-fins in a turn, and may be used to make the control problems effectively disappear. The placement of the additional fins in relation to the parallel side-fins may therefore be selected from the group of settings consisting of: forward and outboard of the mid-chord of the side-fin and fixed at a negative angle of attack (wherein outboard is defined as the side of the side-fin facing the perimeter edge or rail), rearward and outboard of the mid-chord of the side-fin and fixed at a negative angle of attack, and inboard and to one side of the mid-chord of the side-fin, and parallel to the longitudinal centerline or stringer.

An advantage of the present invention is that the inventive shaping of the fin members and arrangement of such on a surfboard provide greater acceleration and stability, particularly during turning maneuvers.

Another advantage of the present invention is that the shaping of the fin members and the placement of fins on the surfboard may be adjusted to conform to the parameters of the individual user, including weight, balance and typical movement speed.

These and other objects and advantages of the various embodiments of the invention will be better understood with the context provided by the detailed description of invention, and upon viewing the drawings.

BRIEF DESCRIPTION OF THE DRAWINGS

The first several figures of the drawing (FIGS. 1-3) depict prior art and are discussed above.

Figure 4:
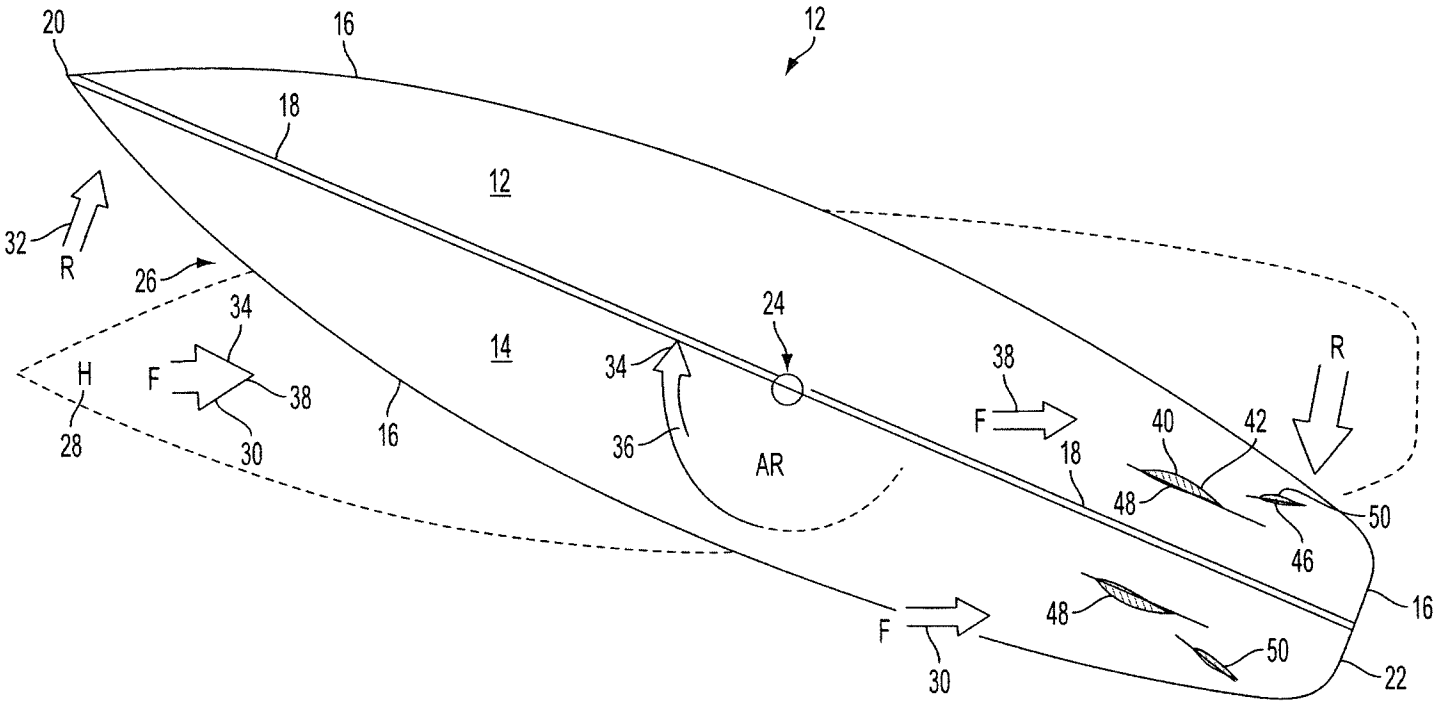
Figure 5:
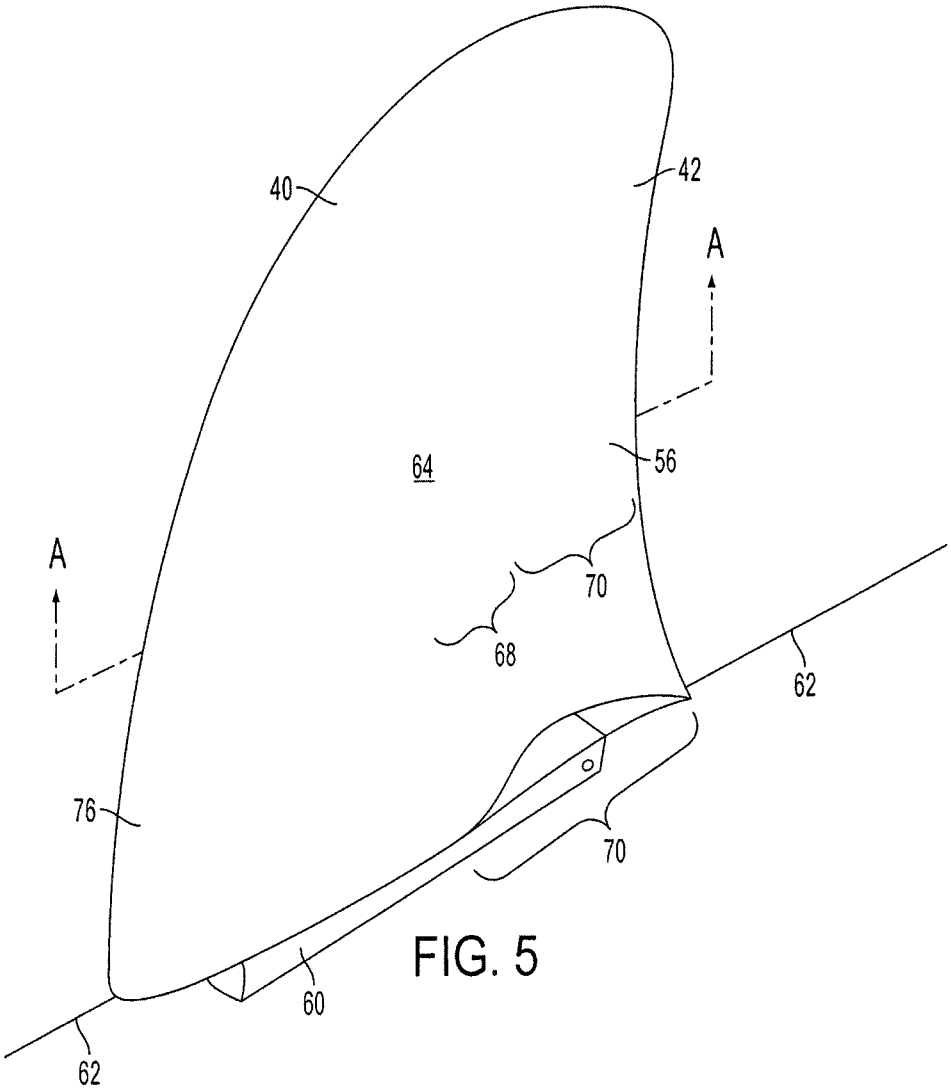
Figure 5A:
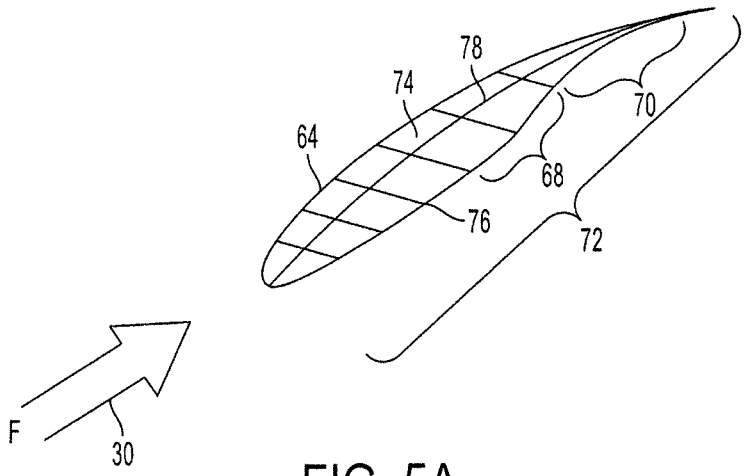

The purposes and advantages of the present invention will be apparent from the following detailed description in conjunction with the appended drawings in which:

FIG. 4 is a bottom plan view of a typical surfboard with the system of the present invention being installed thereupon and also showing, in phantom, a turn having been made;

FIG. 5 is a perspective view of an inventive fin member according to the present invention, shown disassembled from the board;

FIG. 5A is a cross-section view of the fin foil of FIG. 5 taken along line A-A, showing how an oscillating curvature on the inside surface of the fin, opposite the cambered side, can be used to reduce turbulence and drag when the fin is at a negative angle of attack.

Figure 6:
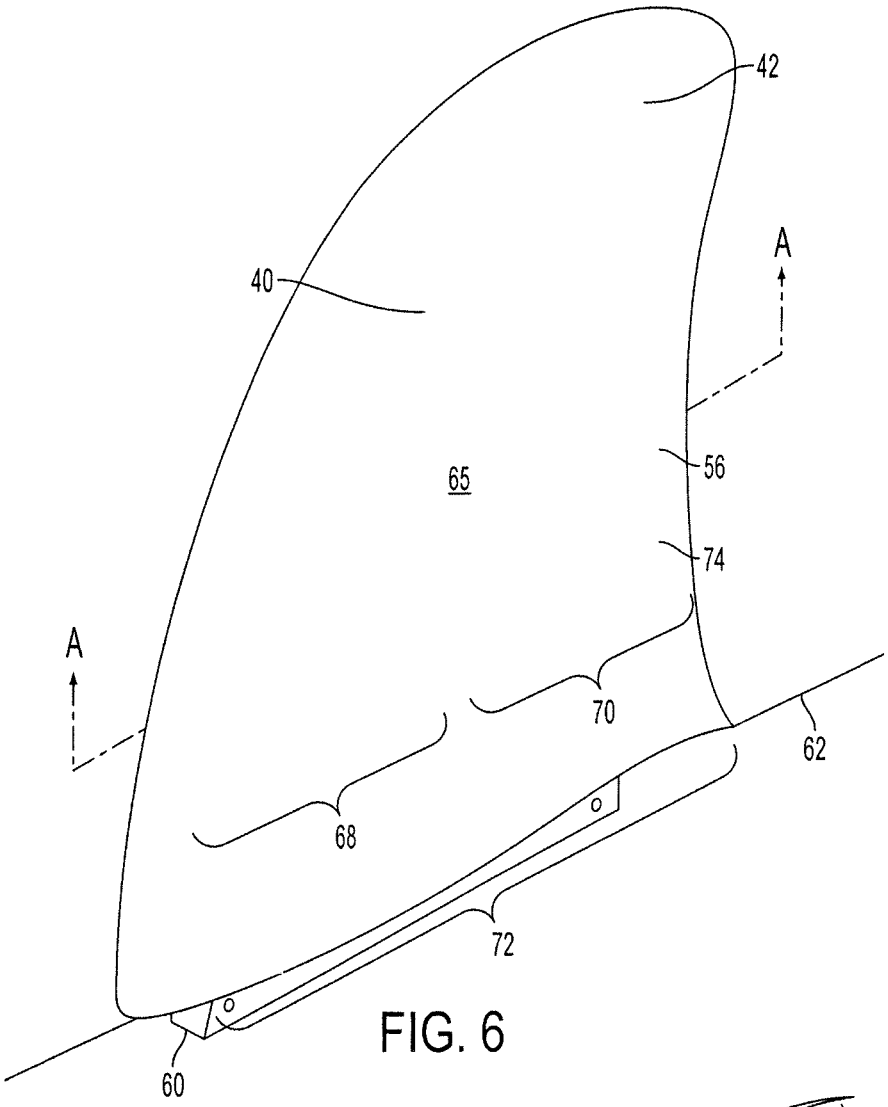
Figure 6A:
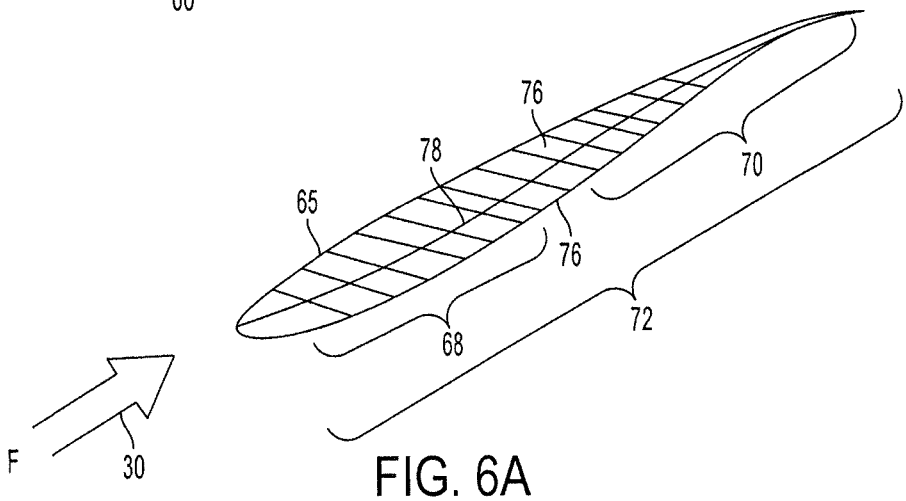

FIG. 6 is a perspective view of another inventive fin member according to the present invention, shown disassembled from the board;

FIG. 6A is a cross-section view of the fin foil of FIG. 6 taken along line A-A, showing how an oscillating curvature on the cambered side of the fin.

Figure 7:
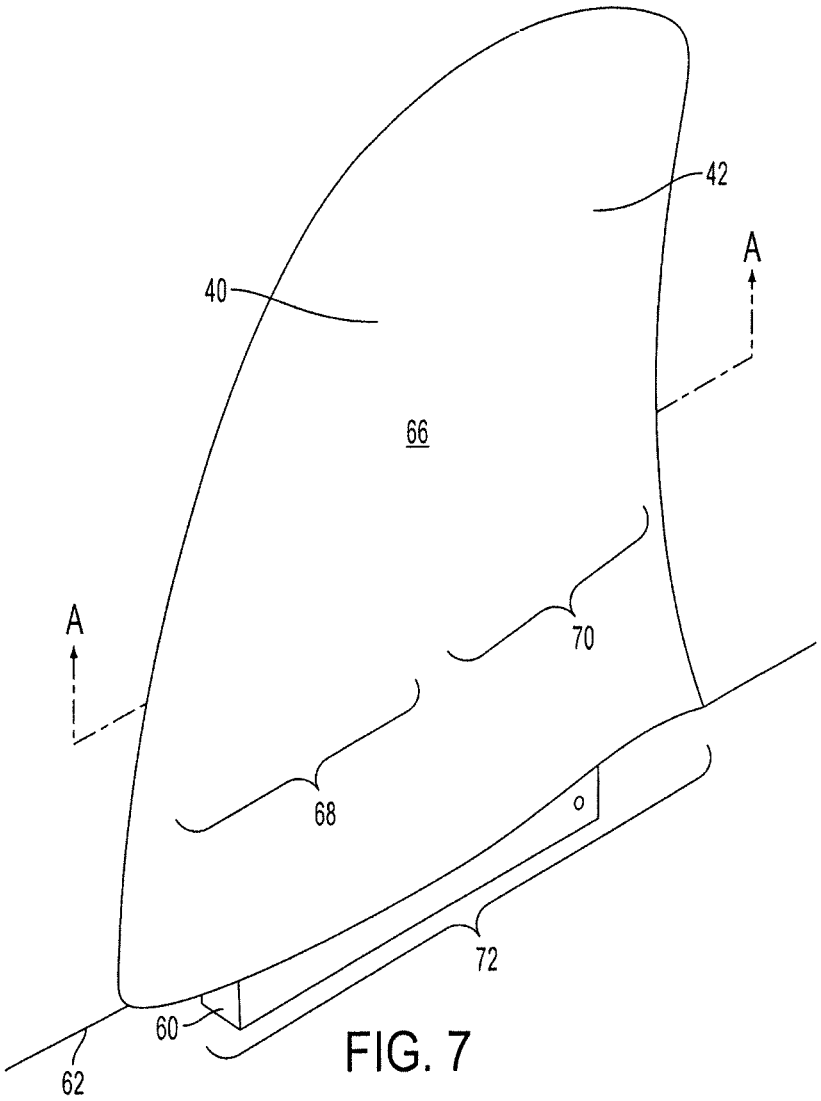
Figure 7A:
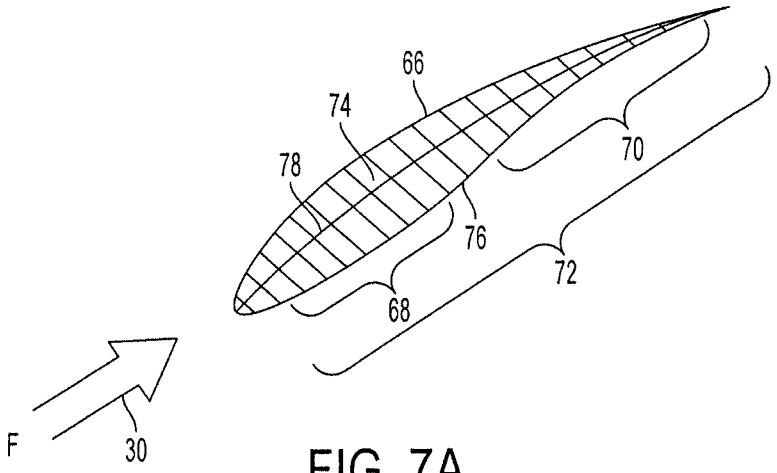

FIG. 7 is a perspective view of still another inventive fin member according to the present invention, shown disassembled from the board;

FIG. 7A is a cross-section view of the fin foil of FIG. 7 taken along line A-A, showing how an oscillating curvature on the inside surface of the fin, opposite the cambered side, can be used to reduce turbulence and drag when the fin is at a negative angle of attack.

Figure 8:
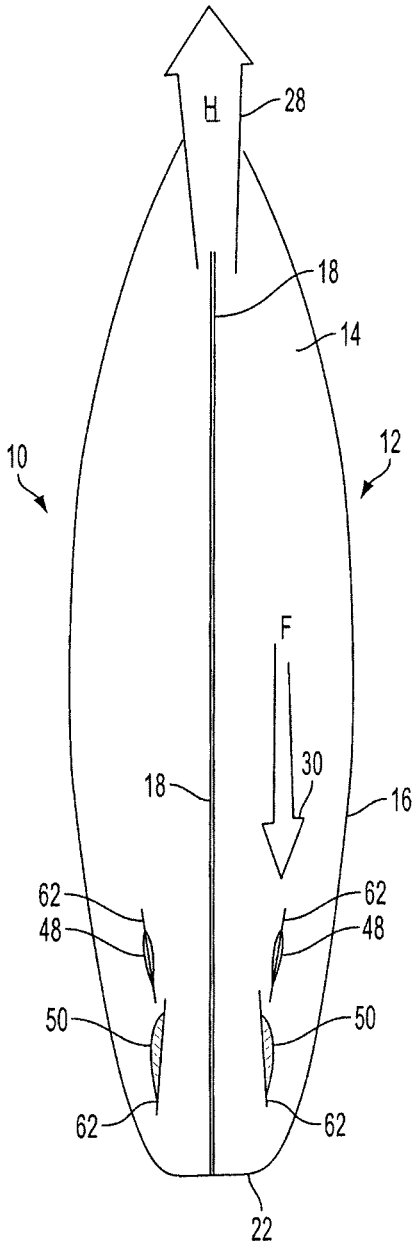

FIG. 8 is a bottom plan view of a multi-fin configuration according to the present invention showing how the higher angle of attack of a forward fin versus the lesser angle of attack of a rearward fin will create a yawing moment that aids the rotation of the board in a turn.

Figure 9:
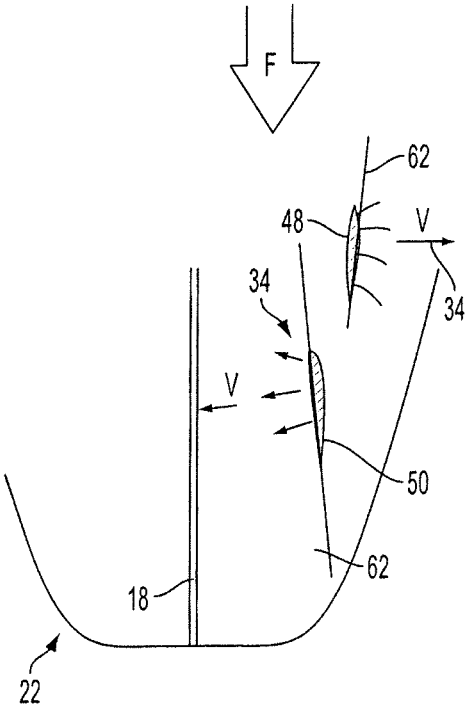

FIG. 9 is a close up view of a portion of the tail section of the board according to the configuration of FIG. 8.

Figure 10:
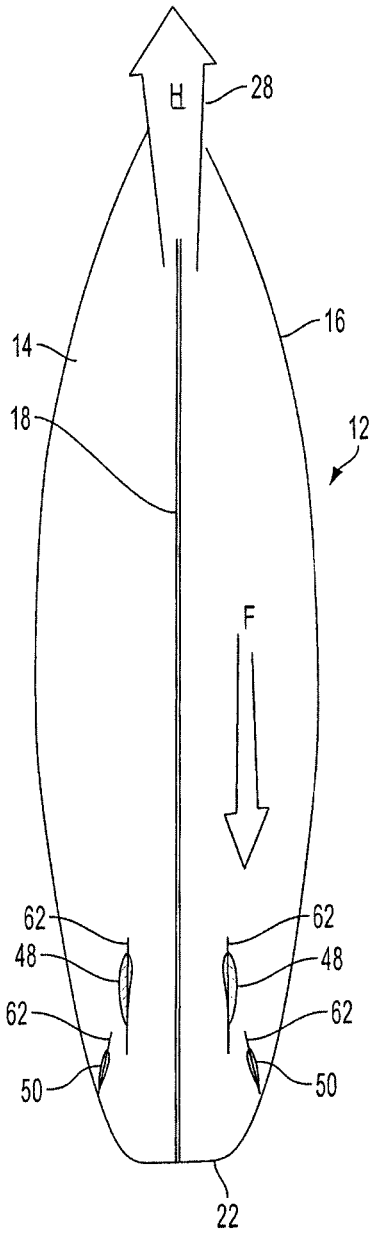

FIG. 10 is a view of a multi-fin configuration according to the present invention illustrating how the negative angle of the trailing side-fin acts as a deflected rudder and creates a yawing moment that aids the rotation of the board in a turn.

Figure 11:
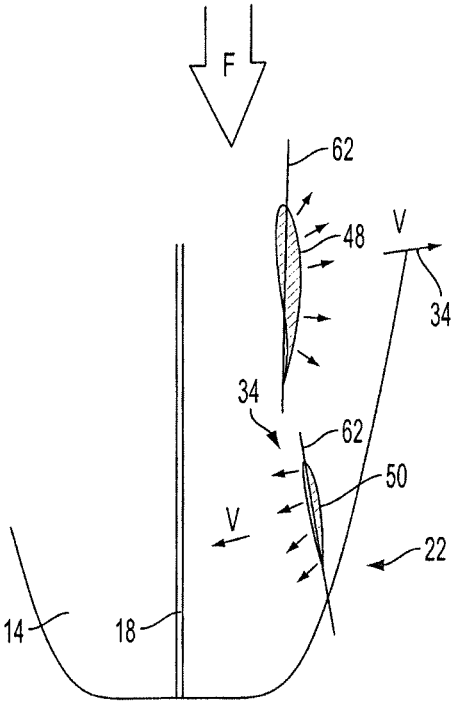

FIG. 11 is a close up view of a portion of the tail section of the board according to the configuration of FIG. 10.

BEST MODE FOR CARRYING OUT THE INVENTION

The preferred embodiment of the present invention is a system for providing a surfboard with improved fins, arranged in an improved pattern, with said pattern being customizable to the specific characteristics of the user. As illustrated in the various illustrations of the drawing herein, this preferred embodiment of the inventive surfboard system is depicted and referred to by the general reference character 10. The system 10 is adapted to optimize the characteristics of a multi-fin form of surfboard 12 for use by proficient surfers.

FIG. 4 illustrates, in a bottom plan view, a typical surfboard 12, with a turn being shown in phantom. As the present invention is adaptable for use with surfboards of a wide variety of configurations, the particular shape of the surfboard 12 illustrated in this figure is selected for purposes of illustration only.

The typical surfboard 12 includes an under surface 14 which is shown. This is the portion which faces downward into the water during use. It also has an upper side (not shown) upon which the surfer rides and stands. An edge, also known as a perimeter rail 16, extends around the periphery of the board 12. A longitudinal center line 18 (often a structural feature of the board) divides and bisects the board 12 longitudinally. The center line 18, when a physical part of the board 12, is also known as a stringer 18. The board 12 is also characterized by having a front 20 (bow) and a rear 22 (tail). Although not an apparent physical characteristic, each board also has a vertical rotation axis 24 which defines the center point about which the board 12 effectively rotates during turns see phantom representation of pre-turn position).

For the purposes of discussion, various external physical factors and forces are relevant. These are somewhat discussed above in connection with the prior art. These include a heading 28 which is the direction of absolute travel of the board, and a water flow direction 30 of the wave which will normally coincide with the heading 28, but in the opposite direction. A rotation force 32 is applied by the user in order to achieve a turn. Various force vectors 34 are created by the interaction of the medium (water or air) with the components of the board and a yaw moment 36 may be envisioned to reflect the twisting forces involved. A drag force 38 also exists and is characterized and the force acting against the forward movement of the board along the heading 28.

The principal aspects of the present invention are embodied in a plurality of fins 40 which are situated on the board 12. These fins 40 come in various sizes and placement positions and significantly affect the board in use. Each fin has a portion which acts as a foil 42, similar to an airplane wing.

Among the types of fins 40 which appear in the present invention are center fins 44, situated along the center line 18 (see FIG. 3A), side fins 46 situated between the center line 18 and the rail 16, and forward fins 48 and rearward (tail) fins 50 which are defined by their relative positions. A given fin 40 may be characterized by more than one of these descriptors. For an example, a given fin 40 may be both a side fin 46 and a tail fin 48.

Each fin 40 has various components, as particularly illustrated in FIGS. 5, and 5A, 6 and 6A, and 7 and 7A. Each has a leading edge 52, and outside surface 54 (closer to the rail 16), an inside (lee) surface 56 (closer to the center line 18) and a trailing edge 58. Each fin 40 also includes a mounting protrusion 60 by which it is mounted on the board 12. A virtual portion of each fin 40 is a chord 62 which is a vertical plane passing through the center point of the leading edge 52 and the trailing edge 58 of the fin 40 and extending outward therefrom. The chord 62 is useful in understanding the effect of the foil 42 on the flow medium and the handling of the board 12.

The selection and placement of fins 40 is the object of the system 10 of the invention. The present invention therefore discloses a number of multi-fin configurations designed with the problems of reverse yaw—the source of the original multi-fin control problems—fully taken into account. Some of these settings are shown in FIGS. 8-11 and are discussed in connection therewith. According to the present invention, when properly designed, a multi-fin configuration can be successfully based a parallel side fin 46 setting (see example in FIG. 3B); the parallel side fin setting not only reduces drag when the rider's weight is neutrally centered on the board, but in a turn the side fin 46 is placed at a significantly higher angle of attack—this dramatically improving the acceleration of the board since it allows the fin to more closely approximate the function of a sail. The problems of reverse yaw are prevented by additional fins 40 or fin-foils 42 set at a specific angle so as to dampen or counter the adverse effects of the fin foil 42 at the higher angle of attack. This greatly enhances speed and control through the arc of the turn; moreover, the additional foils 42 may be deployed so as to function as permanently deflected control surfaces that provide the yawing moment 36 and aid the rotation 32 of the board in the direction of the turn. According to actual embodiments, this can dramatically improve the "looseness" and subjective feel of the board while enhancing its overall maneuverability as well.

As described in more detail below, the present invention discloses a number of fin-foils that reduce drag at the conventional negative angle of attack, and perform exceptionally well when the fin is set substantially parallel to the longitudinal center line 18 or stringer of the board 12. FIG. 5, FIG. 6, and FIG. 7 are perspective views of such fins, while FIG. 5A, FIG. 6A and FIG. 7A are cross-section views, taken along the respective lines A-A of the associated figure, depicting the foil 42 of a first configuration fin 64 (FIG. 5), a second configuration fin 65 (FIG. 6) and a third configuration fin 66 (FIG. 7) according to the present invention. As shown in FIGS. 5 and 7, the inside surface 56 of the configured fins 64 and 66 (assuming mounting on the right rear portion of the board 12) has a first side with a convex curvature 68 from the leading edge 52 that curves first in one direction, followed by a second, concave curvature 70 in the opposite direction, such that a portion of the lee side 56 of the fin has an oscillating curvature 72 similar in shape a to a shallow sine wave. The fin 64 also has an upper end 55 which is independent from other fins and is unencumbered (as shown in FIGS. 8-11), i.e., not connected to other fins, and a bottom end 53 which delimits the lower extremity of the foil 42 where it meets the board 12. The illustrations of FIGS. 5 and 7 show the oscillating curvature 72 on the non-cambered side 76 while FIG. 6 illustrates a configuration where the oscillating curvature 72 is on the cambered side 74, which is the outside surface 54 in FIG. 6.

Each fin 40 acts as the foil 42 with respect to the fluid through which the fin is traveling. To operate as an effective foil, each fin 40 has a cambered side 74 and a non-cambered side 76. A virtual camber line 78 is used to define the degree of horizontal curvature and cambering of the foil 42 against the plane of the virtual chord 62, which intersects the bottom 14 of the board 12 at the chord line 62. The plane includes the chord line 62, which is a straight, horizontal line passing from a center point on the fin's very leading edge 52 to a center point at the very trailing edge 58; the chord line 62 also extends outward from the very leading edge 52 and the very trailing edge 58—the virtual chord 62 allows the angle of the fin 40 to be accurately set against the centerline 18, and is useful in understanding the fluid flow patterns around the fin 40. The cambered side 74 may be the outside surface 54 or the inside (lee) surface 56 of the fin 40, depending on the configuration and mounting of the particular fin 40.

Referring now to FIGS. 5, 6 and 7, the present invention 10 discloses a series of cambered fin foils 42 that exhibit greatly reduced drag at the conventional negative angle of attack due to the oscillating curvature 72 on the non-cambered surface 76 of the fin 40 (and opposite the cambered side 74), and also performs exceptionally well when the fin is set substantially parallel to the longitudinal centerline or stringer 18 of the board. As shown, this is advantageous in that the oscillating curvature 72 on one side of a forward fin foil 40 can be used to create a "sidewash," similar to the "downwash" known to exist behind an airplane wing, that changes the direction of the water flow F striking a trailing fin foil, thereby altering the effective incidence or angle of attack of a trailing fin 50, which in this view has a "reflexed" foil, as the oscillating curvature 72 is on the cambered side 74; combined, these effects can be effective in reducing drag and increase the yawing moment of the board in a turn (as described in greater detail below).

FIG. 5 is a perspective view of a fin 40 illustrating a configuration where the oscillating curvature 72 is on the non-cambered surface 76 of the fin. The cross sectional view of FIG. 5A illustrates how the oscillating curvature 72 comprises a "forward" (toward the fin's leading edge) convex curvature 68 followed by trailing concave curvature 70. The view also depicts the chord line 62, an imaginary straight line drawn through the leading 52 and trailing edges 58 of the fin 64, which is used to measure the angle of attack of the particular fin 40.

FIG. 5A, a cross-section view taken along lines A-A of FIG. 5, provides a view of the foil section 42 of the fin 40; the fin foil is cambered, as represented by the camber line 78 which shows that the fin 40 has an average curvature greater on the cambered side 74, than the non-cambered side 76. The cross-section view shows that the foil of the fin 40 according to the present invention exhibits the oscillating curvature 72. This involves a convex curvature 68 that curves first in one direction, followed by a second, concave curvature 70 in the opposite direction. Thus a portion of one side of the fin has an oscillating curvature 72 similar in shape to a shallow sine wave. As shown, the oscillating curvature 72 allows the forward portion of the fin 40 (e.g., from approximately mid-chord 62 forward to the leading edge 52) to have a curvature approaching a symmetrical foil, giving it a low-drag, streamlined shape. However, in the trailing portion both sides of the fin 40 curve in the same direction, to make the overall foil section of the fin cambered. The fin foil shown has been found to reduce drag when used at the conventional negatively angled side-fin setting, and it appears to reduce the required toe-in to an angle of less than 3.degree.; in addition, it performs very well when placed substantially parallel to the stringer (when the fin is set approximately .+–0.2.degree. to the centerline or stringer 18).

Arrangements are feasible (see FIGS. 7 and 6A) where the oscillating curvature 72 is on the cambered side 74 of the narrow fin 65, and the trailing edge 58 curves in a direction opposite the forward part. This curvature would create a "reflexed" foil that has a slight yawing moment 36 in the direction of the cambered side 74 due to the high pressure area and pressure differential resulting from the reflexed curvature near the trailing edge 58. When the fin 40 is set substantially parallel to the centerline 18, the yawing moment 36 can be used to aid the rotation of the board in a turn. (Note: when the oscillating curvature 72 occupies one entire side of the fin, the curvature 72 will be understood to be distinct from the severe curvature present at the leading edge 52, although a precise demarcation is not shown. In addition, the curvature may occupy only a portion of one side of the fin, e.g., from approximately mid-chord to the trailing edge 58.)

Figure 1A:
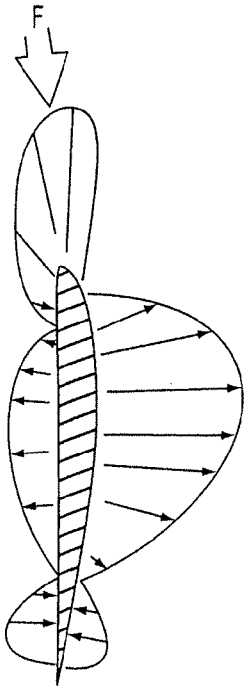
FIG. 1A (prior art)
FIG. 1A (Prior Art) is a cross-section view of a fin foil according to the prior art that depicts the pressure field assumed to develop around the foil of a fin when it is positioned at a low incidence or angle of attack relative to a water flow.
Figure 1B:
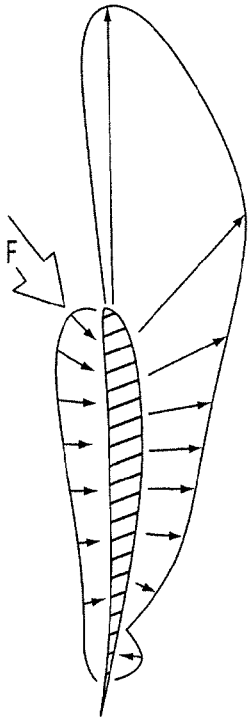
FIG. 1B (prior art)
FIG. 1B (Prior Art) is cross-section view of a fin foil according to the prior art that depicts the pressure field assumed to develop around the foil of a fin as a result of a very high incidence or angle of attack.

In particularly advantageous embodiments of the present invention 10, the juxtaposition of fin foils 42 is such that the lesser or negative angle of attack of a rearward fin 50 foil, versus the higher or positive angle of attack of a forward fin 48 foil, creates a yawing moment 36 that aids the rotation of the board in a turn; as noted above, this can dramatically improve the "looseness" and subjective feel of the board, while enhancing overall maneuverability as well. Equally important, however, the yawing moment 36 and the resulting rotation of the board causes at least one forward fin 48 to come at a progressively higher angle of attack; from the preceding discussion, it can be seen that the pressure differential (see FIG. 1A and FIG. 1B above) around the forward fin 48 will enhance both the rotation and the acceleration of the board through the arc of a turn, while the lesser angle of attack of the rearward fin 50 can be used to counter the reverse yaw of the forward fin 48, so that the rider can maintain complete directional control.

FIG. 8 provides a first example and shows a board 12 with an inventive arrangement of fins 40 at the tail 22. Companion FIG. 9 shows a close up view of the tail 22 section, illustrating the same configuration as FIG. 8. In each of these views the fins are arranged so that a forward fin 48 is in a low-drag position which, as shown, is substantially parallel to but at a slightly positive angle of attack to the centerline 18, while the position of the trailing fin 50, in relation to the forward fin 48, is set at a negative angle of attack. In the example shown, the rider's weight is assumed to be neutrally centered on the board. This causes the water-flow 30 to roughly parallel to the centerline 18 of the board as shown, and creates a pressure field around the fins (48, 50) depicted here by the small vector arrows 34 shown. The pressure field creates a pressure differential, the direction of which is represented by the two larger vector arrows V that are shown pointing in opposite directions on the two sides of either fin (48, 50). As depicted, the negative angle of attack of the trailing fin 50 versus the positively angled forward fin 48 creates the yawing moment 36 and a side fin 42 setting that is directionally unstable, in that as soon as the rider leans to turn the board (not depicted) and lifts the opposing side-fins (not shown) free of the water, the yawing moment 36 of the fins (48, 50) will cause the board 12 to rotate. This allows the forward fin 48 to lead the rotation of the board through the arc of the turn while the rearward fin 50, which is set fairly close to the centerline 18 and almost directly under the rider's feet, allows the rider to maintain directional control.

Figure 2:
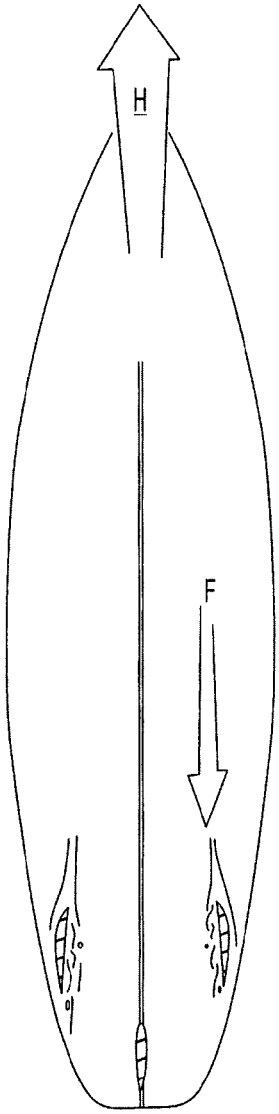
FIG. 2 (prior art)
FIG. 2 (Prior Art) is view of the bottom of a surfboard depicting a conventional tri-fin arrangement according to the prior art, and the low-pressure area or turbulence that develops on the lee or inside surface of the side-fins due to the negatively angled "toe-in" of the side-fins.
Figure 2A:
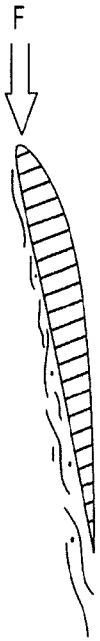
FIG. 2A (prior art)
FIG. 2A (Prior Art) is a closer, longitudinal cross-sectional view of the "flat-sided" foil of a side-fin according to the prior art.
Figure 2B:
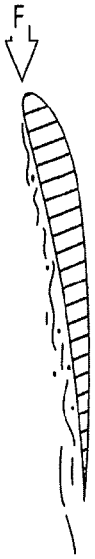
FIG. 2B (prior art)
FIG. 2B (Prior Art) is a cross-sectional view of a prior art side-fin foil having a slightly concave inside surface; both views show the high drag, which is depicted as turbulent water flow, that develops on the lee or inside surface due to the side-fin's negative angle of attack or "toe-in" towards the longitudinal centerline at the nose.
Figure 3A:
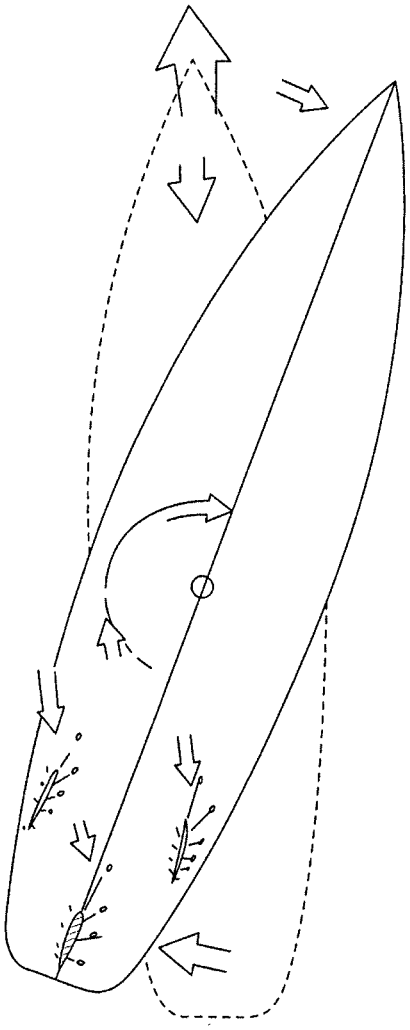
FIG. 3A (prior art)
FIG. 3A (Prior Art) is a view of the bottom of a prior art tri-fin board in a turn that shows how the rotation of the board in a turn changes the direction of water-flow striking the fin(s), and thereby alters the fins' angle of attack.
Figure 3B:
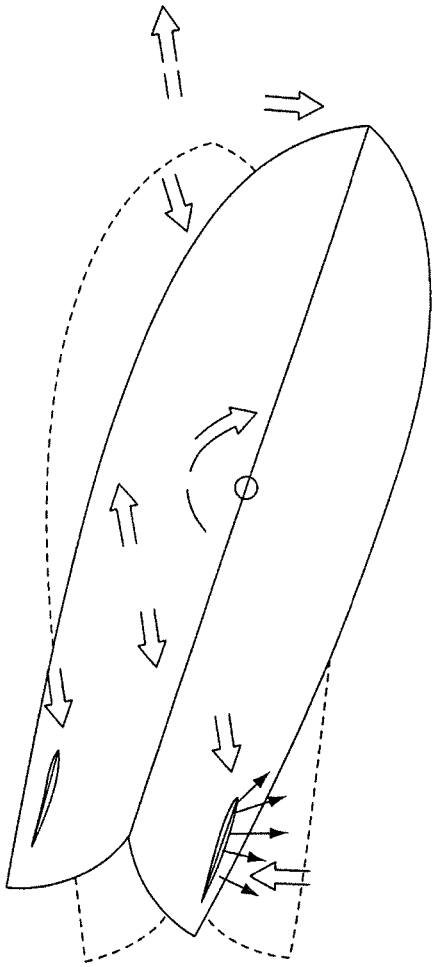
FIG. 3B (prior art)
FIG. 3B (Prior Art) depicts the bottom of a prior art "fish" style board with the largely unsuccessful parallel side-fin setting, and shows how the wide split tail and parallel side-fin setting will cause the side-fins to be placed at a much higher angle of attack due to the rotation of the board in a turn.

In a second example, FIG. 10 shows a board 12 with another inventive arrangement of fins 40 at the tail 22. Companion FIG. 11 shows a close up view of the tail 22 section, illustrating the same configuration as FIG. 10. FIG. 11, provides a partial view of the tail 22 section in which the fins 40, depicted here in cross-section, are in an especially advantageous configuration. In the embodiment shown, the rearward trailing fin 50 is positioned to function as a permanently deflected rudder that aids the rotation of the board through the turn, while the forward fin 48 is in a low drag position paralleling the stringer 18. In the example shown, the rider's weight is again neutrally centered on the board. This causes the water-flow 30 to roughly parallel the longitudinal centerline 18 of the board 12, which creates a pressure field/pressure differential around the forward fin 48 in the direction of the vector arrow V that is opposite the direction of the pressure differential and vector V of the rearward trailing fin 50. In the embodiment shown, the placement of the trailing fin 50 is further behind the axis of rotation 24 when compared to the negatively angled side-fin setting of the prior art (as shown in FIG. 2), and the increased leverage greatly increases the maneuverability of the board. When the rider leans to initiate a turn (not depicted; the rotation of a prior art tri-fin is shown in FIG. 3A), the added leverage of the trailing fin 50 creates a yawing moment 36 that aids the rotation of the board which also causes the forward fin to be immediately placed at a higher angle of attack (again, vs. the negatively angled side-fin setting of the prior art). From the discussion of the pressure differential provided above (see, e.g., FIG. 1A and FIG. 1B), it can be seen that this will enhance both the rotation and the acceleration of the board—as the board is rotated, it increases the pressure differential around the forward fin 48 which further enhances the rotation of the board in a turn—at the same time, the rotation of the board causes the water-flow 30 striking the forward fin 48 to come at a progressively higher angle of attack (vs., e.g., the rotation of the prior art tri-fin depicted in FIG. 3A), thereby considerably enhancing the board's drive and acceleration as it is maneuvered on the wave; while the trailing fin 50 counters the reverse yaw of the forward fin 48 and allows the rider to maintain control.

Persons knowledgeable in the art will recognize that the principles described hereinabove may be applied to other board types such as "hybrids," "eggs," "modern longboards," etc., by reversing the prior art tri-fin setting: that is, the center stabilizing fin may be placed on the longitudinal centerline or stringer of the board and forward of the negatively angled, trailing side-fins on either perimeter rail. In addition, the oscillating curvature of either fin may be "reflexed," or conventionally cambered; and the multi-fin configurations disclosed are not limited in terms of the foil of the fin, but may use any of fin foils known in the art. In addition, the size and planshape of the fin may be selected according to the specific performance characteristics sought—i.e., the forward fin 48 may be considerably larger than the trailing fin and vice-versa.

The present invention also discloses that the control problems associated with very early double-finned surfboards, which were poorly understood but had long been attributed to the parallel side-fin setting used on the original fish style boards, were actually caused by a side-fin setting that placed the side-fins too close to the tail 22 and to the perimeter edge or rail 16. It has been discovered that a side-fin setting that is substantially parallel to the centerline 18 may be successfully used if the side fins 46 are moved further forward on the board, so the setting is closer to the board's axis of rotation 24 and further away from the board's perimeter edge or rail 16. Specifically, it was found that if the setting of the side fin 46 is such that the leading edge 52 of the side fin 46 as measured at its base is at least twenty percent of the total distance forward of the tail 22 (or, alternatively, if the mean hydrodynamic chord of the side fin 46 is set at least fifteen percent of the total length of the board forward of the tail 22), and if the side fins 46 are placed so that the distance between centerline 18 and the mid-chord 62 of the side fin 46 as measured at its base is no greater than one-third the total width of the board 12 at that point, the control problems resulting from a substantially parallel side-fin setting largely disappear.

In working embodiments, when the above side-fin setting was compared to a modern twin fin type board of the prior art, it was found to dramatically increase speed and responded immediately to very small weight shifts by the rider. Although problems of reverse yaw still existed, they were greatly reduced with a fairly low aspect ratio fin with symmetrical or reflexed foil. In preferred embodiments, additional fins or fin foils were used that successfully dampened, counteracted or eliminated the problem of the reverse yawing moment of the side-fins in a turn. The group of placements found to be successful in countering the reverse yaw comprised: forward and outboard of the mid-chord of the side-fin and fixed at a negative angle of attack (wherein outboard is defined as the side of the side-fin facing the perimeter edge or rail), rearward and outboard of the mid-chord of the side-fin and fixed at a negative angle of attack, and inboard and to one side of the mid-chord of the side-fin, and parallel to the longitudinal centerline or stringer.

In the prior art, the multi-fin configurations that have been successful were arrived at through trial and error, with a poor or very limited understanding of the "lift" and pressure differential characteristics of the fin, and in particular without knowledge of the heretofore unidentified but entirely predictable problems associated and the reverse yaw of the fin-foil at high angles of attack. This has had the effect of discouraging or greatly limiting innovation in multi-fin design.

Persons skilled in the art will therefore recognize that the multi-fin configurations disclosed herein may be adapted or modified according to individual performance preferences, skill levels or technique. In addition, it will be understood that in the preceding discussion, the various references and descriptions that have been made have included simplifications, exaggerations for purposes of clarity, and subjective interpretations of what may be a fairly complex interplay of a number of different phenomena. These descriptions have been presented in order to better illustrate the invention; the spirit and scope of the present invention, however, is not limited to the specific embodiments described above, but includes the various modifications and functional equivalents that a person skilled in the art of surfboard design might make using the principles disclosed herein. While various embodiments have been described above, it should be understood that they have been presented by way of example only, and not limitation.

INDUSTRIAL APPLICABILITY

By incorporating the principles and teachings of the present invention, surfboards of improved acceleration and handling may be fabricated. Utilization of fins 40 having foils 42 with the oscillating curvature 72 described above will dramatically alter the handling characteristics of a multi-fin surfboard and will result in smoother handling and control. Incorporating the inventive fin configurations can also increase acceleration and control characteristics. Selection and placement of the fins 40 in accordance with the parameters of the rider can result in optimal performance, particularly in turns.

For the above, and other, reasons, it is expected that the surfboard fin system 10 of the present invention will have widespread industrial applicability. Therefore, it is expected that the commercial utility of the present invention will be extensive and long lasting.

I claim:

1. A surfboard comprising:

an elongated board body having a nose region, a center, a tail region, and a longitudinal centerline passing from the nose region to the tail region, wherein the nose and tail regions comprise a nose edge and a tail edge delimiting a front edge and a rear edge at a very extremity of the board, and the center is a longitudinal point disposed on the longitudinal centerline equidistant from the very extremity of the board at either end;

wherein, the board comprises a plurality of independent side-fins on a bottom surface of the board body, and the independent side-fins are positioned in a multi-fin arrangement, and the multi-fin arrangement comprises:

an independent rearward side-fin extending from the bottom surface of the board body and set at a negative angle of attack with respect to the longitudinal centerline, and an independent forward side-fin extending from the bottom surface of the board body and positioned forward of the rearward side-fin, wherein the rearward side-fin is set outboard of the forward side-fin, and the forward side-fin is set at an angle of attack that is substantially parallel to the longitudinal centerline, and further wherein:

the independent side-fins in the multi-fin arrangement are located forward of the rear edge at the very extremity of the tail, and rearward of the center of the board, and offset from the longitudinal centerline, and the juxtaposition of the side-fins is such that it creates a yawing moment that aids the rotation of the board in a turn.

2. The surfboard of claim 1 wherein the forward side-fin has a first side surface, a leading edge, a second side surface opposite the first side surface, and a trailing edge opposite the leading edge, and further wherein the forward side-fin has a virtual chord in the form of a vertical plane passing through a respective center point of the leading edge and the trailing edge of the fin, and further wherein the virtual chord of the forward side-fin is set to be parallel to the longitudinal centerline of the board body.

3. The surfboard of claim 1, wherein at least one of the side-fins is a cambered foil, and further wherein the at least one side-fin has a first side surface, a leading edge, a second side surface opposite the first side surface, and a trailing edge opposite the leading edge, wherein the first and second side surfaces have a horizontal curvature, and the horizontal curvature of the second side surface is continuously convex through a vertical extent of the side-fin, and further wherein the horizontal curvature of the first side surface has a first convex curvature in one direction, and a second concave curvature in an opposite direction, such that the first side surface has an oscillating curvature similar to a shallow sine wave.

4. The surfboard of claim 1 further including fin attachment points adapted to secure the side-fins to the bottom of the board body.

5. A surfboard comprising:

an elongated board body having a nose, a center, and a tail with a longitudinal centerline passing from the nose to the tail, and a plurality of independent side-fins disposed on a bottom surface of the board body and comprising an independent rearward side-fin and an independent forward side-fin, wherein the rearward side-fin extends from the bottom surface of the board body and is set at a negative angle of attack with respect to the longitudinal centerline of the board body, and the forward side-fin extends from the bottom surface of the board body and is set forward of the rearward side-fin, and further wherein the rearward side-fin is set outboard of the forward side-fin, and the forward side-fin is set at an angle of attack that is substantially parallel to the longitudinal centerline of the board body, and further wherein both the forward side-fin and rearward side-fin are located forward of the tail and rearward of the center of the board body, and offset from the longitudinal centerline, and further wherein the juxtaposition of the side-fins is such that it aids the rotation of the surfboard in a turn.

6. The surfboard of claim 5 wherein the forward side-fin has a first side surface, a leading edge, a second side surface opposite the first side surface, and a trailing edge opposite the leading edge, and further wherein the forward side-fin has a virtual chord in the form of a vertical plane passing through a respective center point of the leading edge and the trailing edge of the fin, and further wherein the virtual chord of the forward side-fin is set to be parallel to the longitudinal centerline of the board body.

7. The surfboard of claim 5, wherein at least one of the side-fins is a cambered foil, and further wherein the at least one side-fin has a first side surface, a leading edge, a second side surface opposite the first side surface, and a trailing edge opposite the leading edge, wherein the first and second side surfaces have a horizontal curvature, and the horizontal curvature of the second side surface is continuously convex through a vertical extent of the side-fin, and further wherein the horizontal curvature of the first side surface has a first convex curvature in one direction, and a second concave curvature in an opposite direction, such that the first side surface has an oscillating curvature similar to a shallow sine wave.

8. The surfboard of claim 5 further including fin attachment points adapted to secure the side-fins to the bottom of the board body.

* * * * *